US010933278B2

(12) United States Patent
Moridaira

(10) Patent No.: US 10,933,278 B2
(45) Date of Patent: Mar. 2, 2021

(54) SLIDER

(71) Applicant: JUTE inc., Tokyo (JP)

(72) Inventor: Shigeo Moridaira, Tokyo (JP)

(73) Assignee: JUTE inc., Tokyo (JP)

( * ) Notice: Subject to any disclaimer, the term of this patent is extended or adjusted under 35 U.S.C. 154(b) by 0 days.

(21) Appl. No.: 16/944,156

(22) Filed: Jul. 31, 2020

(65) Prior Publication Data

US 2020/0376331 A1 Dec. 3, 2020

Related U.S. Application Data

(63) Continuation of application No. PCT/JP2020/019669, filed on May 18, 2020.

(30) Foreign Application Priority Data

May 29, 2019 (JP) ..... JP2019-100514

(51) Int. Cl.

| | |
|---|---|
| ***A63B 22/20*** | (2006.01) |
| ***A63B 21/00*** | (2006.01) |
| *A63B 23/00* | (2006.01) |
| *A63B 23/12* | (2006.01) |

(52) U.S. Cl.

CPC ..... *A63B 22/20* (2013.01); *A63B 21/0004* (2013.01); *A63B 21/4035* (2015.10); *A63B 21/4043* (2015.10); *A63B 23/1236* (2013.01); *A63B 2023/003* (2013.01)

(58) Field of Classification Search

CPC ..... A63B 21/0004; A63B 21/4035; A63B 21/4041; A63B 21/4043; A63B 22/20; A63B 2022/0038; A63B 2022/0041; A63B 2023/006; A63B 23/1236

See application file for complete search history.

(56) References Cited

U.S. PATENT DOCUMENTS

| | | | | |
|---|---|---|---|---|
| 6,219,845 | B1 * | 4/2001 | Ferriter | A41D 13/0568 2/24 |
| 7,481,753 | B2 * | 1/2009 | James | A63B 23/12 482/140 |
| 8,016,732 | B2 * | 9/2011 | Susnjara | A63B 22/14 482/142 |
| 8,382,645 | B2 * | 2/2013 | Mylrea | A63B 21/4035 482/51 |
| 8,827,879 | B2 * | 9/2014 | Nicholas | A63B 21/0004 482/132 |
| 8,876,677 | B2 * | 11/2014 | Meininger | A63B 23/03541 482/132 |
| 9,028,382 | B2 * | 5/2015 | Chang | A63B 23/0233 482/132 |

(Continued)

FOREIGN PATENT DOCUMENTS

| | | | |
|---|---|---|---|
| JP | 2005-160902 | A | 6/2005 |
| WO | 2013/142422 | A | 9/2013 |

*Primary Examiner* — Megan Anderson

(74) *Attorney, Agent, or Firm* — Yokoi & Co., U.S.A.; Toshiyuki Yokoi

(57) ABSTRACT

Provided is a stretching slider excellent in compactness and lightweightness and exhibiting high stability and slipperiness. A stretching slider includes a plate-shaped member having a first surface as a front surface and a second surface as a back surface and a plurality of ball rollers provided on the second surface for moving the plate-shaped member in all directions along a horizontal direction.

10 Claims, 8 Drawing Sheets

(56) References Cited

U.S. PATENT DOCUMENTS

| | | | | |
|---|---|---|---|---|
| 9,358,419 | B1 * | 6/2016 | Smith | A63B 23/1209 |
| 10,307,635 | B1 * | 6/2019 | Khalil | A63B 21/4035 |
| 2005/0209072 | A1 | 9/2005 | Sheron | |
| 2011/0105288 | A1 * | 5/2011 | Susnjara | A63B 21/0004<br>482/142 |
| 2013/0023391 | A1 | 1/2013 | Nicholas | |
| 2017/0266489 | A1 * | 9/2017 | Douglass | A63B 21/068 |
| 2018/0036588 | A1 * | 2/2018 | Brown | A63B 21/0004 |

* cited by examiner

SLIDER

BACKGROUND OF THE INVENTION

1. Field of the Invention

The present invention relates to a lightweight and compact stretching slider for health promotion (sometimes briefly called as a slider), muscle strength enhancement, and the like.

2. Description of the Related Art

US 2005/0,209,072 (FIGS. 7A and 7B, FIG. 1, paragraphs 38-40, etc.) discloses an example of stretching sliders of the related art. FIGS. 7A and 7B are explanatory diagrams of this stretching slider 100. Specifically, FIG. 7A is a diagram illustrating an example of use of the stretching slider 100 and FIG. 7B is a side view illustrating an overview of the stretching slider 100.

The stretching slider 100 of the related art includes a spherical body 101 large enough to be gripped by a palm and a strap 102 provided on the top surface portion of the spherical body 101.

Provided in the spherical body 101 are one large roller ball 101a, an upper cover 101b, a lower cover 101c, a bearing system 101d, and a fixing member 101e.

The roller ball 101a is disposed between the upper cover 101b and the lower cover 101c.

The bearing system 101d is housed between the upper cover 101b and the roller ball 101a. The bearing system 101d is housed between the upper cover 101b and the roller ball 101a by the fixing member 101e.

When this stretching slider 100 is used, a person grips the top surface of the spherical body 101 with a hand 110 and fixes the hand 110 to the spherical body 101 with the strap 102. When the person applies a load to the spherical body 101, the stretching slider 100 freely moves in the direction of the load and desired exercise can be done as a result.

In addition, WO 2013/142422 A (claims, FIG. 15, etc.) discloses an example of compact limb support exercise systems enabling both abdominal muscle exercise and back muscle exercise in a prone posture.

More specifically, the limb support exercise system includes a first limb slider 200 and a second limb slider 300 and is capable of supporting the body of a user 400 when the user slides his or her body across a ground surface in order to do exercise.

The limb sliders support the body as illustrated in FIG. 8. As a result, the sliding exercise on the ground surface is facilitated and various exercises can be done.

SUMMARY OF THE INVENTION

However, the stretching slider 100 described in US 2005/0,209,072 (FIGS. 7A and 7B, FIG. 1, paragraphs 38-40, etc.) includes one roller ball 101a, and thus it is difficult to maintain compactness and there has been a problem in terms of lightness as well.

In addition, the stretching slider 100 has been problematic in that the stretching slider 100 lacks stability and whether or not a certain stretching effect can be obtained depends heavily on a user's physical ability such as physical strength.

Accordingly, in a case where a user is a senior citizen, a child, or the like without sufficient physical strength, for example, it is difficult to obtain a stable stretching effect and concerns over an injury or the like have arisen in some cases.

In addition, the first and second limb sliders of the limb support exercise system described in WO 2013/142422 A (claims, FIG. 15, etc.) slide across a ground surface, and thus the limb support exercise system has low slipperiness and it has been difficult to do exercise with stability on a floor surface having a high friction coefficient.

In this regard, the inventor of the present application has made intensive efforts in view of such a problem. As a result, the inventor of the present application has found that a stretching slider having a specified configuration is excellent in compactness and lightweightness and exhibits suitable stability and slipperiness and completed the invention.

In other words, an object of the invention is to provide a stretching slider excellent in compactness and lightweightness and exhibiting high stability and slipperiness.

A stretching slider of the invention includes a plate-shaped member having a first surface as a front surface and a second surface as a back surface and a plurality of ball rollers provided on the second surface for moving the plate-shaped member in all directions along a horizontal direction.

According to such a configuration, the stretching slider includes the plate-shaped member and the small ball roller industrially mass-produced as described in the embodiment, and thus compactness and lightweightness can be improved.

In addition, according to the stretching slider of the invention, the plate-shaped member is used and the plate-shaped member itself can be stably placed on a floor or the like via the plurality of ball rollers. Accordingly, high stability can be exhibited during use.

In addition, since the movement of the stretching slider is performed via the ball roller, the stretching slider is excellent in slipperiness and can be easily used even on a floor surface having a high coefficient of friction.

In addition, the stretching slider of the invention is excellent in economy since the stretching slider is a simple structure as described above.

In addition, it is preferable that the plurality of ball rollers are provided at least along an edge of the second surface in the configuration of the stretching slider of the invention.

In a case where the stretching slider is used, an external force may be concentrated on and applied to the edge portion of the plate-shaped member.

Without any consideration, the stretching slider may tilt around the fulcrum where the external force is concentrated and the movement of the stretching slider may be hindered in a case where the external force is locally applied as described above.

On the other hand, when the plurality of ball rollers are provided along the edge of the second surface as in this preferred example, the ball roller easily receives the external force even in a case where the external force is concentrated on the edge portion of the plate-shaped member, and thus the degree of tiling of the stretching slider can be reduced.

Accordingly, the stability of the stretching slider can be further improved and dependence on a user's physical ability such as physical strength can be reduced.

In addition, it is preferable that the plurality of ball rollers are radially provided when viewed from a center point of the plate-shaped member assumed in the plate-shaped member (point Q of FIG. 2A) in the configuration of the stretching slider of the invention.

With this configuration, the external force applied to the plate-shaped member can be received in a more dispersed manner, and thus the stability of the stretching slider is further improved.

It should be noted that the ball roller, as a matter of course, may also be provided near the edge of the plate-shaped member and provided near the planar center of the plate-shaped member. In such a case, strength improvement can be achieved near the middle of the plate-shaped member.

In addition, it is preferable that a shortest distance between center points of the plurality of ball rollers (see the point R of FIG. 2C) and an edge portion of the plate-shaped member is a value within the range of 10 to 50 mm in the configuration of the stretching slider of the invention.

With this configuration, it is possible to dispose the plurality of ball rollers in the edge portion of the plate-shaped member in accordance with predetermined design criteria, and thus the degree of tilting of the stretching slider can be reduced and the stability can be further improved.

It should be noted that the above-described configuration considers a case where an escape dimension a (see FIG. 2C) from the edge of the plate-shaped member is required so that attachment strength or the like is ensured when the ball roller is attached to the plate-shaped member.

In addition, the distance between the plurality of ball rollers and the edge portion of the plate-shaped member may be the same for all of the ball rollers or may be different in part in some cases.

In addition, it is preferable that a height of protrusion of the ball roller from the second surface is a value within the range of 5 to 30 mm in the configuration of the stretching slider of the invention.

With this configuration, it is possible to prevent more-than-necessary separation of the plate-shaped member from a floor or the like, and thus the degree of tilting of the stretching slider can be reduced and the stability can be further improved.

In addition, it is preferable that a cushioning member is stacked on the first surface of the plate-shaped member in the configuration of the stretching slider of the invention.

The stacking of the cushioning member results in a reduced impact on a person during stretching and a closer contact between the stretching slider and the person's part such as palm.

Accordingly, the stability of the stretching slider can be further improved and dependence on a user's physical ability such as physical strength can be reduced.

It should be noted that the cushioning member may be a single-layer configuration or a multilayer configuration. This is preferable because the degree of freedom in cushioning member design is enhanced.

In addition, it is preferable that a maximum diameter in a planar shape of the plate-shaped member is a value within the range of 15 to 35 cm in the configuration of the stretching slider of the invention.

With this configuration, a person's part such as hand, knee, toe, and sole can be placed on the stretching slider in a more stable state during stretching.

It should be noted that the maximum diameter in the invention means the diameter of a circumscribed circle drawn to circumscribe the planar shape of the plate-shaped member.

It is preferable that a planar shape of the plate-shaped member is at least one selected from a circular shape, a quadrangular shape, a polygonal shape, and a different shape in the configuration of the stretching slider of the invention.

With this configuration, a person's part such as hand, knee, toe, and sole can be placed on the stretching slider in a more stable state during stretching and the stretching slider can be suitably designed.

DETAILED DESCRIPTION OF THE PREFERRED EMBODIMENTS

Figure 1:
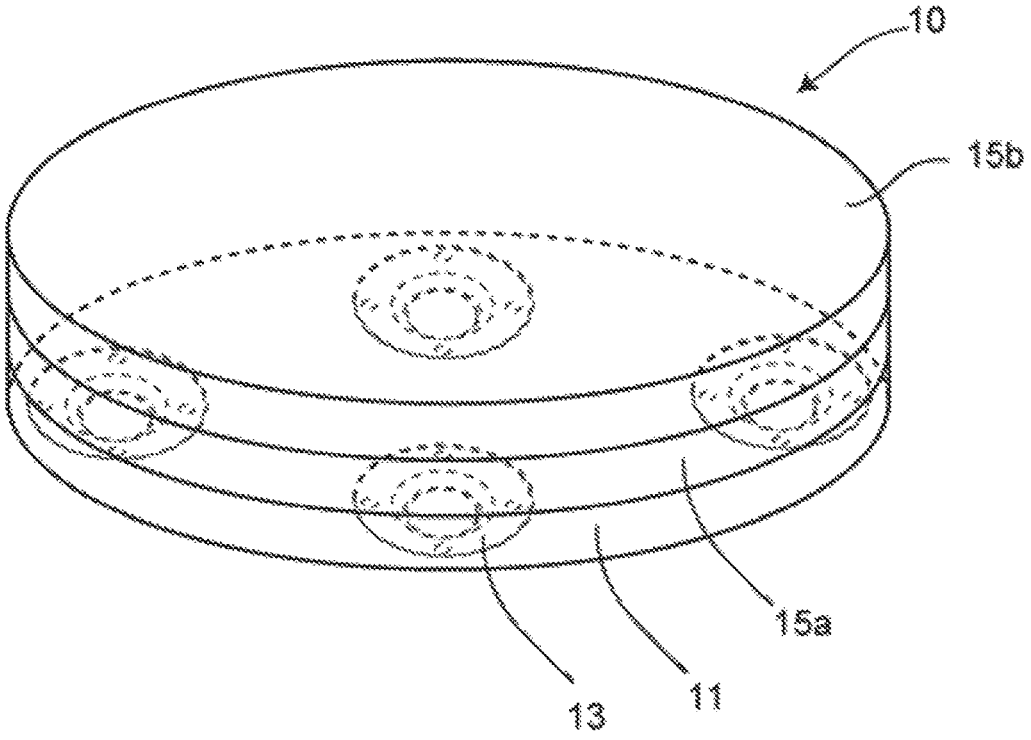
FIG. 1 is a perspective view provided for describing a stretching slider of the invention that is viewed from a first surface side.

Hereinafter, embodiments of the invention will be described with reference to the drawings as appropriate. It should be noted that the same components are denoted by the same reference numerals in the drawings used for the description and description thereof may be omitted.

First Embodiment

Figure 2A:
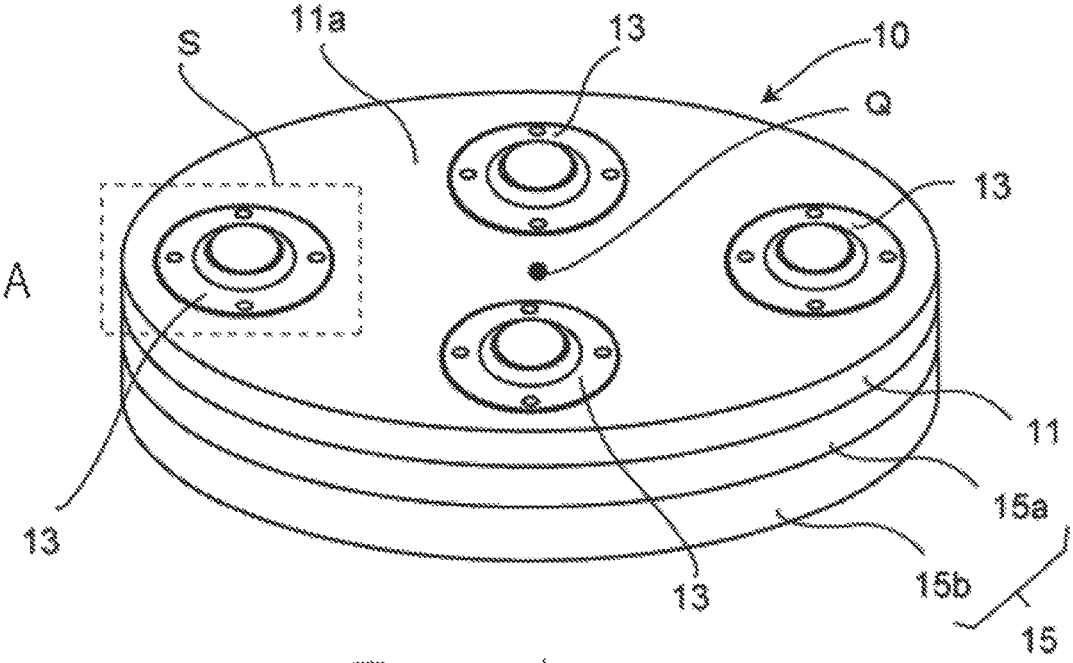
FIGS. 2A, 2B, and 2C are views provided for describing a ball roller in the stretching slider of the invention.
Figure 2B:
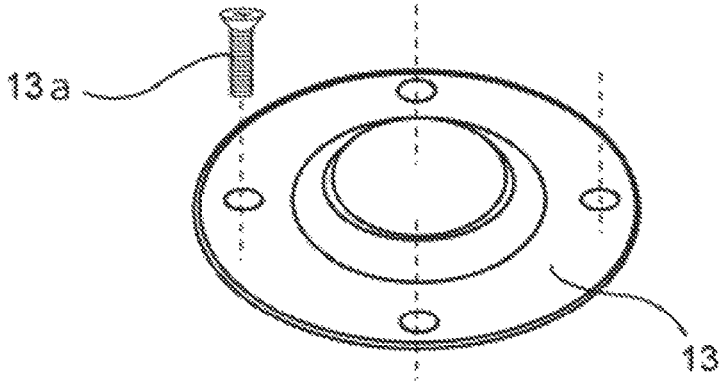
Figure 2C:
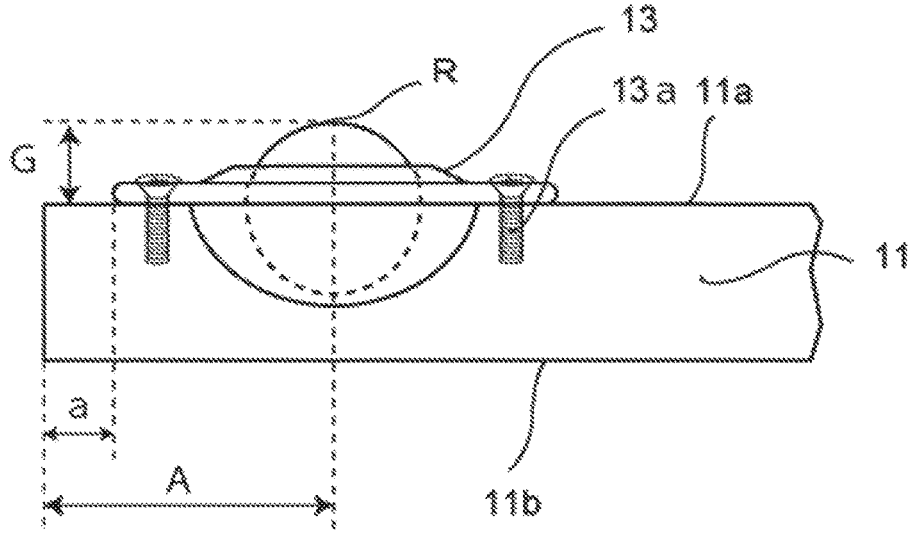

FIG. 1 is a perspective view for describing a stretching slider 10 of a first embodiment (hereinafter, sometimes referred to as a stretching slider (No. 1)). Specifically, FIG. 2A is a perspective view of the stretching slider 10 that is viewed from a second surface. FIG. 2B is an enlarged perspective view of a ball roller 13. FIG. 2C is a side view describing a preferable disposition relationship of the ball roller 13 with respect to a plate-shaped member 11.

1. Plate-Shaped Member

The stretching slider 10 of the first embodiment includes the plate-shaped member 11 and a plurality of the ball rollers 13. The plate-shaped member 11 has a first surface 11*b* as a front surface and a second surface 11*a* as a back surface.

(1) Constituent Material

Although not particularly limited, the constituent material of the plate-shaped member 11 preferably includes at least one selected from wood, metal, resin, and ceramic in consideration of the life, cost, and the like required for the stretching slider 10.

For example, metal is satisfactory in consideration of strength, resin or the like is satisfactory in consideration of lightweightness and strength, and wood is satisfactory in consideration of workability.

It should be noted that the thickness of the plate-shaped member 11 may be any thickness at which strength as the stretching slider 10 can be obtained and it is preferable that the thickness is, for example, a value within the range of 10 to 50 mm although the thickness is not limited thereto.

(2) Planar Shape

The planar shape of the plate-shaped member 11 in the invention can be appropriately changed depending on the application. It is preferable that the planar shape is at least one selected from, for example, a circular shape, a quadrangular shape, a polygonal shape, and a different shape.

This is because a person's part such as hand, knee, toe, and sole can be placed on the stretching slider 10 in a more stable state during stretching and postural stability during use can be further enhanced with the above-described shape.

In addition, this is because it is possible to suitably design the stretching slider 10 by adopting a substantially petaline shape or a substantially stellate shape as illustrated in a later embodiment.

It should be noted that it is preferable to machine corner portions into curved surfaces in the case of the quadrangular shape, the substantially stellate shape, or the like.

(3) Size

It is preferable that the maximum diameter in the planar shape of the plate-shaped member 11 is a value within the range of 15 to 35 cm.

This is because it is difficult to place a person's part such as hand, knee, toe, and sole on the stretching slider 10 in a stable state during stretching and stability decreases when the maximum diameter is a value of below 15 cm.

In addition, this is because compactness or lightweightness may decrease and the ease of handling or carrying may not be maintained when the maximum diameter is a value of above 35 cm.

Accordingly, the maximum diameter in the planar shape of the plate-shaped member 11 is more preferably a value within the range of 18 to 32 cm and further preferably a value within the range of 20 to 30 cm.

It should be noted that the maximum diameter in the invention means the diameter of a circumscribed circle assumed to circumscribe the planar shape of the plate-shaped member 11.

(4) Cushioning Member

In addition, it is preferable that a cushioning member 15 is stacked onto the first surface 11*b* of the plate-shaped member 11 in the configuration of the stretching slider 10 of the invention.

This is because the stacking of the cushioning member 15 results in effects such as a reduced impact on a person during stretching and a closer contact between the stretching slider 10 and the person's part such as palm, knee, toe, and sole.

Accordingly, the stability of the stretching slider can be further improved and dependence on a user's physical ability such as physical strength can be reduced.

The cushioning member 15 may be a multilayer configuration although the cushioning member 15 may be a single-layer configuration insofar as desired physical properties can be obtained.

The multilayer configuration is advantageous in that, for example, a desired thickness can be achieved with another layer in a case where it is difficult to obtain the desired thickness with one layer and the multifunctional cushioning member 15 utilizing the physical properties of each material can be configured.

It should be noted that the thickness of the cushioning member 15 may be any thickness at which suitable cushioning is obtained while the lightweightness of the stretching slider 10 is maintained and the thickness is preferably, for example, a value within the range of 10 to 40 mm although the thickness is not limited thereto.

In addition, it is preferable that the cushioning member 15 is usually a member containing at least one of urethane resin, EVA resin, styrene resin, polyester resin, and acrylic resin.

This is because moderate cushioning and close contact can be obtained along with excellence in workability, lightweightness, and economy.

It should be noted that the cushioning member 15 in the case of the stretching slider 10 of the first embodiment is a two-layer structure of a first cushioning member 15*a* and a second cushioning member 15*b*, which are provided in order from the plate-shaped member 11 side.

The first cushioning member 15*a* is made of, for example, urethane rubber and the second cushioning member 15*b* is made of ethylene vinyl acetate (EVA) although the materials are not limited thereto. The thickness of each of the first cushioning member 15*a* and the second cushioning member 15*b* is approximately 10 mm although the thickness is not limited thereto.

(5) Recess Portion or Unevenness

In addition, it is preferable that the first surface 11*b* of the plate-shaped member 11 is provided with a recess portion 17 or unevenness 19, which receives a person's part such as hand, knee, toe, and sole, in the configuration of the stretching slider 10 of the invention.

Figure 3A:
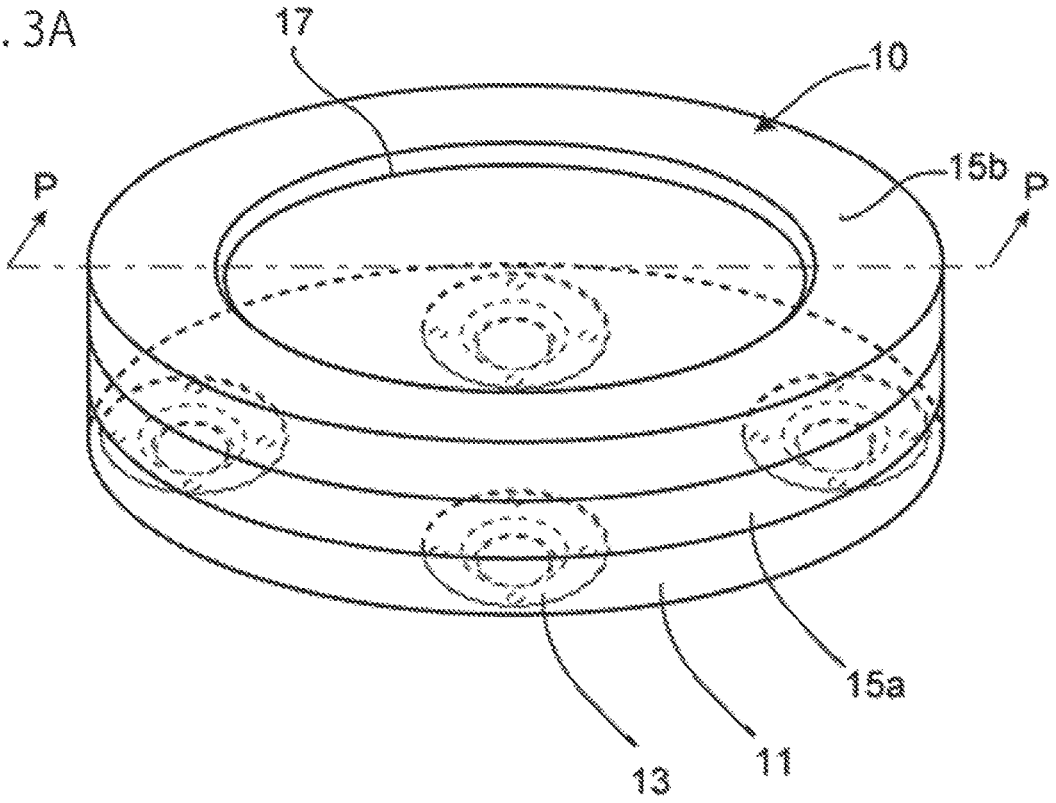
FIGS. 3A and 3B are views provided for describing a recess portion provided in the stretching slider of the invention.
Figure 3B:
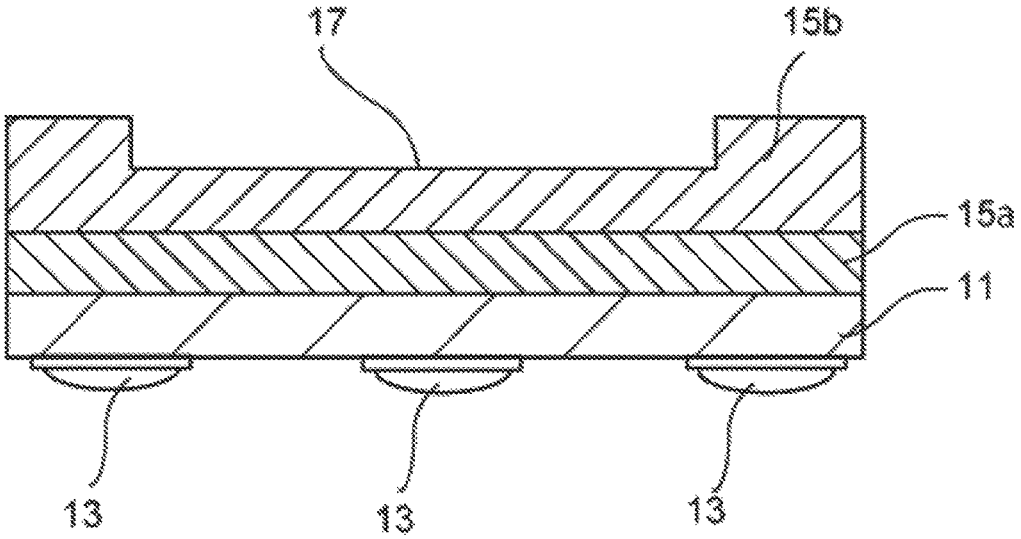

FIGS. 3A and 3B are a view describing the recess portion 17. Specifically, FIG. 3A is a perspective view of the stretching slider 10 that is viewed from the first surface 11*b* side. FIG. 3B is a cross-sectional view of the stretching slider 10 along line P-P of FIG. 3A.

Figure 5A:
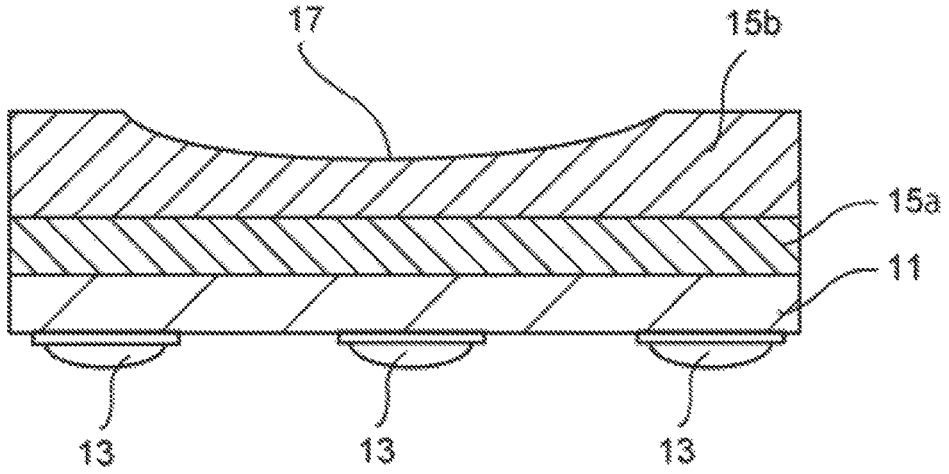
FIG. 5A is a view provided for describing another example of the recess portion.
Figure 5B:
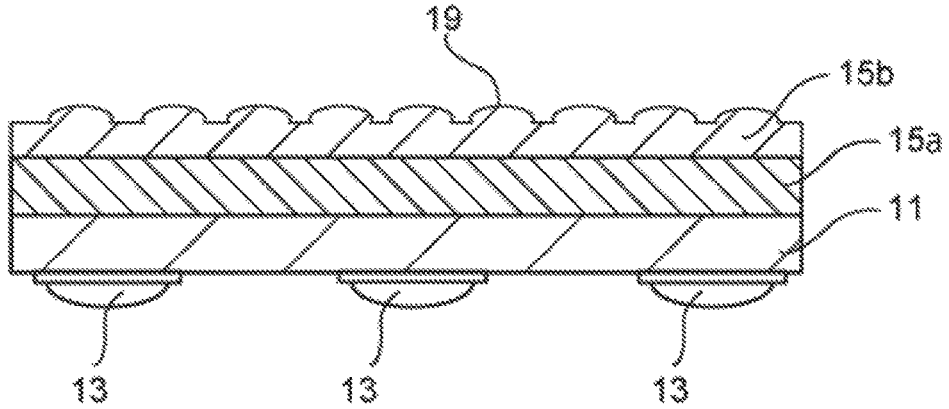
FIG. 5B is a view provided for describing an example of providing an uneven shape.

It should be noted that the recess portion 17 is preferably provided in the cushioning member 15 in a case where the cushioning member 15 is stacked onto the first surface 11*b*, as is exemplified by FIGS. 3A and 3B. In addition, an example of the unevenness 19 is illustrated in FIG. 5B.

By the recess portion 17 or the unevenness 19 being provided in this manner, the sitting of a person's part such as palm, knee, toe, and sole on the stretching slider 10 is further enhanced, and thus postural stability during the use of the stretching slider is further improved.

The shape of the recess portion 17 or the unevenness 19 is not particularly limited. For example, the recess portion 17 or the unevenness 19 may have a recessed shape which is formed into a curved surface as illustrated in FIG. 5A or may have a shape imitating a human palm.

The depth of the recess portion 17 is preferably a depth at which the durability of the stretching slider 10 can be maintained and it is possible to play a role as the recess portion 17 and the depth is preferably a value within the range of 5 to 20 mm although the depth is not limited thereto.

In addition, the height difference of the unevenness 19 is preferably a value within the range of 5 to 30 mm although the height difference is not limited thereto.

2. Ball Roller

The stretching slider 10 of the invention includes the plurality of ball rollers 13 on the second surface 11*a* of the plate-shaped member 11.

With this configuration, it is possible to improve the stability of the stretching slider and do stretching exercise regardless of the use environment.

In the stretching slider 10 of the invention, the number and disposition of the ball rollers 13 are important for maintaining stability during use.

In addition, it is important that the ball rollers have a sufficient load bearing capacity because the stretching slider 10 is used with a person's part such as palm, knee, toe, and sole placed on the ball rollers when the stretching slider 10 of the invention is used.

(1) Number

It is preferable that the number of the ball rollers 13 disposed on the second surface 11*a* of the plate-shaped member 11 is at least three or more.

This is because it is possible to improve the postural stability during the use of the stretching slider 10 and further reduce dependence on a user's physical ability such as physical strength as the number of the disposed ball rollers 13 increases.

In addition, this is because the load bearing capacity of the stretching slider 10 as a whole is improved by a load being dispersed to the plurality of ball rollers 13.

Accordingly, the number of the ball rollers 13 is more preferably four or more and further preferably five or more.

It should be noted that the design method of using a large number of small and inexpensive ball rollers 13 can also be adopted although the material cost of the ball rollers 13 may increase when the number is too large.

(2) Disposition

In addition, the ball rollers 13 are provided at least along the edge of the second surface 11*a* and the ball rollers 13 are preferably provided at even positions.

This is because the plate-shaped member 11 becomes less likely to tilt and the stability of the stretching slider 10 can be maintained, even when an external force is concentrated on one place of the edge portion of the plate-shaped member 11, as the disposition of the ball roller 13 becomes closer to the edge of the plate-shaped member 11.

In addition, this is because a load can be uniformly dispersed with respect to the plurality of ball rollers 13 and the load bearing capacity of the stretching slider 10 as a whole is improved as the evenness of the disposition of the ball rollers 13 increases.

Accordingly, the distance between the center point of each of the plurality of ball rollers 13 (point R of FIG. 2C) and the edge portion of the plate-shaped member 11 is preferably a value within the range of 10 to 50 mm, more preferably a value within the range of 12 to 40 mm, and further preferably a value within the range of 15 to 30 mm.

It should be noted that the four ball rollers 13 in the case of the stretching slider 10 of the first embodiment are provided on the second surface 11*a* of the plate-shaped member 11, at the respective tips of two orthogonal lines passing through a planar center point Q, and along the edge of the plate-shaped member 11.

(3) Height

In addition, in order to improve the stability of the stretching slider 10, it is preferable to reduce the height of protrusion of the ball roller 13 from the second surface 11*a*, that is, the distance between the second surface 11*a* and the surface that comes into contact with the lower end of the ball roller 13 (R in FIG. 2C) insofar as the movement of the ball roller 13 is not hindered.

Accordingly, the height of protrusion of the ball roller 13 from the second surface 11*a* is preferably a value within the range of 5 to 30 mm, more preferably a value within the range of 8 to 25 mm, and further preferably a value within the range of 10 to 20 mm.

It should be noted that the ball roller 13 may also be provided near the center point Q of the second surface 11*a* of the plate-shaped member 11 so that the stability or load bearing capacity of the stretching slider 10 is improved (not illustrated).

Further, in the stretching slider 10 of the invention, it is preferable to select the ball roller 13 that is suitable after comprehensively examining the required size, load bearing capacity, and cost based on the above viewpoint.

Various types of such ball rollers manufactured by machine component manufacturers are available in the market, and thus the ball roller 13 is selected from these ball rollers. For example, selection is possible from ball roller product groups provided by manufacturers such as MISUMI Group Inc. and Nabeya Bi-tech Kaisha although the selection is not limited thereto.

It should be noted that the ball roller 13 is typically attached to the plate-shaped member 11 by a fixing member such as a screw 13*a* although the attachment depends on the shape of the ball roller 13. Alternatively, as in the case of the ball roller to be described later with reference to FIG. 5C, the ball roller itself is screwed and fixed to the plate-shaped member 11.

In addition, in the stretching slider 10 of the invention, it is also preferable that the ball roller 13 emits a predetermined sound as the ball roller 13 rotates.

With this configuration, it is easy to find a minor failure of or damage to the ball roller 13 by a change in sound and it is possible to prevent, for example, an excessive breakage attributable to overlapping problems.

Second Embodiment

A stretching slider 20 of a second embodiment (hereinafter, sometimes referred to as a stretching slider (No. 2)) is provided with five ball rollers 13 on the second surface 11*a* of the plate-shaped member 11.

It is preferable that the five ball rollers 13 are disposed at positions corresponding to the five vertices of a regular pentagon.

Figure 4A:
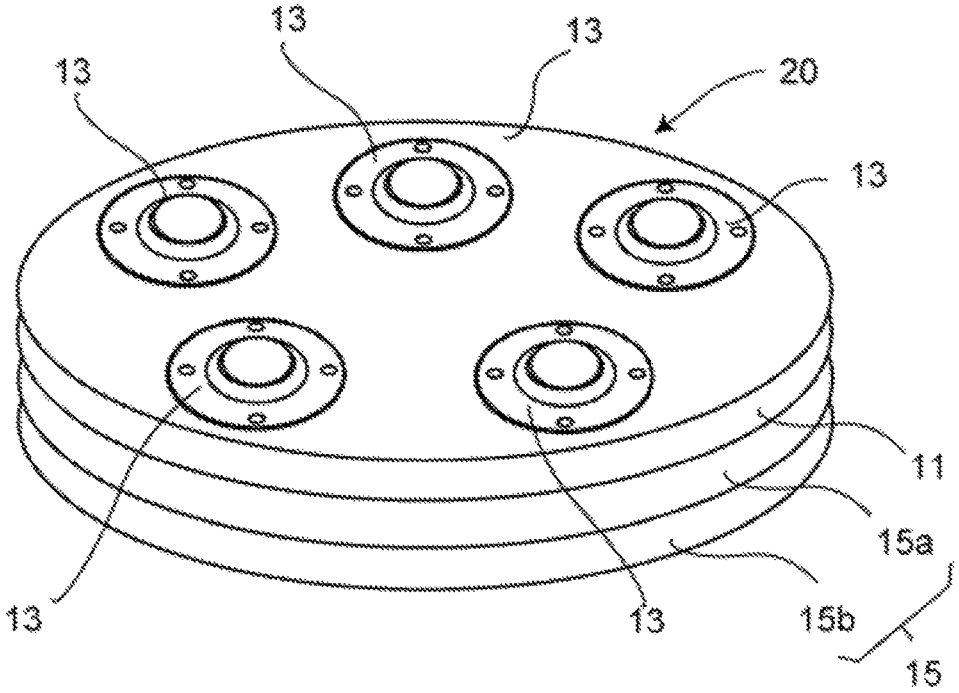
FIGS. 4A and 4B are views provided for describing a modification example of the disposition of a plurality of the ball rollers provided in the stretching slider of the invention.

As illustrated in FIG. 4A, the sitting of the plate-shaped member 11 is better in a case where five ball rollers 13 are used than in a case where four ball rollers 13 are used. As a result, the stability of the stretching slider 20 is improved.

Third Embodiment

Figure 4B:
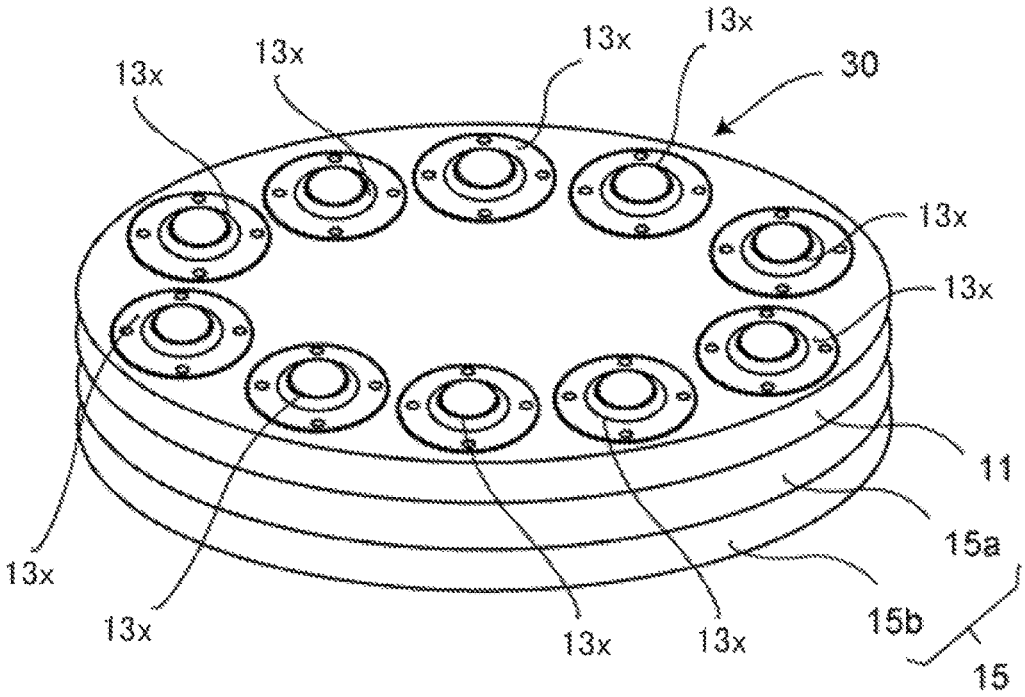

As illustrated in FIG. 4B, a stretching slider 30 of a third embodiment (hereinafter, sometimes referred to as a stretching slider (No. 3)) is an example in which ball rollers 13*x* provided on the second surface 11*a* of the plate-shaped member 11 are smaller in size than the ball rollers of the first embodiment and larger in number than in the first and second embodiments. Ten ball rollers are provided in the illustrated example.

In the case of the stretching slider 30 of this third embodiment, the distance between the center point of each of the plurality of ball rollers 13*x* and the edge portion of the plate-shaped member 11 and the height of protrusion of the ball roller 13*x* from the second surface 11*a* can be further reduced as compared with the first embodiment.

Further, the ball roller 13*x* can be provided at a high density, and thus the stability of the stretching slider 30 is improved and the stretching slider 30 is unlikely to tilt even when an external force is locally concentrated on and applied to the edge of the plate-shaped member 11.

It should be noted that the small ball roller used in the third embodiment is lower in single-unit load bearing capacity than the ball rollers used in the first embodiment and the second embodiment and yet the load bearing capacity of the stretching slider 30 as a whole is suitable by an increased number of ball rollers being disposed.

Fourth Embodiment

Figure 5C:
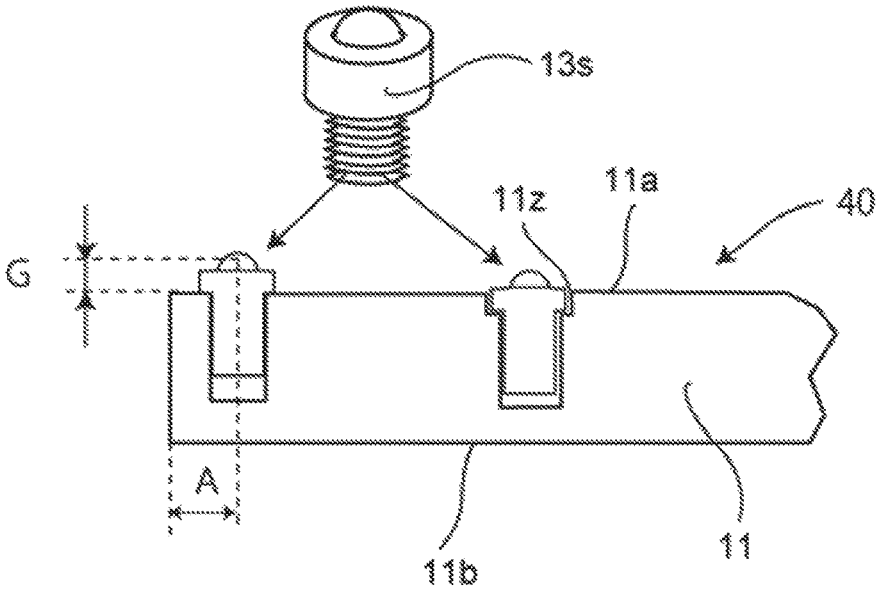
FIG. 5C is a view provided for describing another preferable structural example of the ball roller.

As illustrated in FIG. 5C, a stretching slider 40 of a fourth embodiment (hereinafter, sometimes referred to as a stretching slider (No. 4)) uses a so-called bolt-type ball roller 13*s* as a ball roller.

This bolt-type ball roller 13*s* is advantageous in that the ball roller 13*s* is smaller in planar dimension than the flanged ball roller 13 illustrated in FIGS. 2A-2C.

Specifically, in a case where ball rollers having the same load bearing capacity are compared with each other, the planar dimension of a bolt-type ball roller is approximately two-thirds of the planar dimension of a flanged ball roller.

Accordingly, in the stretching slider 40 of the fourth embodiment using the bolt-type ball rollers 13*s*, the ball rollers can be provided at a higher density and the ball rollers can be provided closer to the edge of the plate-shaped member in comparison with the first embodiment.

Accordingly, the distance between the center point of each of the plurality of ball rollers 13*s* and the edge portion of the plate-shaped member 11 can be further reduced as compared with the first embodiment and the stretching slider 40 is unlikely to tilt even when an external force is locally concentrated on and applied to the edge of the plate-shaped member.

It should be noted that a counterbore portion 11*z* for embedding a part of the ball roller 13, 13*s* in the plate-shaped member 11 may be provided in the plate-shaped member 11 and the ball roller may be provided in the plate-shaped member 11 by means of this counterbore portion, as illustrated in FIG. 5C, when the ball roller 13, 13*s* is provided in the plate-shaped member 11.

The use of the counterbore portion 11*z* is advantageous in that the distance between the second surface 11*a* and the surface that comes into contact with the lower end of the ball roller 13*s* can be reduced.

Fifth Embodiment

Figure 6A:
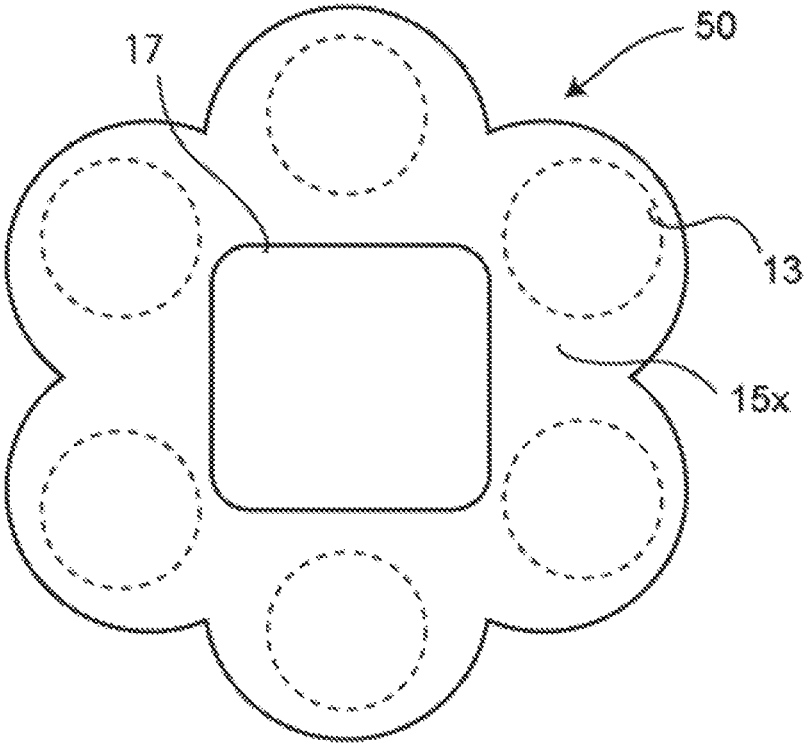
FIGS. 6A and 6B are views provided for describing another example of the planar shape of the stretching slider.

FIG. 6A is a plan view of a stretching slider 50 of a fifth embodiment (hereinafter, sometimes referred to as a stretching slider (No. 5)).

The stretching slider 50 of the fifth embodiment has six round protrusion portions and has a petal-like planar shape.

Such a planar shape may be formed when the plate-shaped member is molded or machined. The ball rollers 13 are respectively provided in the regions of the six round protrusion portions.

The stretching slider 50 of this fifth embodiment is capable of enhancing a product value in terms of design. In addition, since the ball rollers 13 are respectively provided in the regions of the six round protrusion portions, the effect that the sitting of the stretching slider 50 with respect to a floor or the difficulty of tilting in the case of local and intensive external force application to the edge portion of the stretching slider 50 is also enhanced is also obtained.

Sixth Embodiment

Figure 6B:
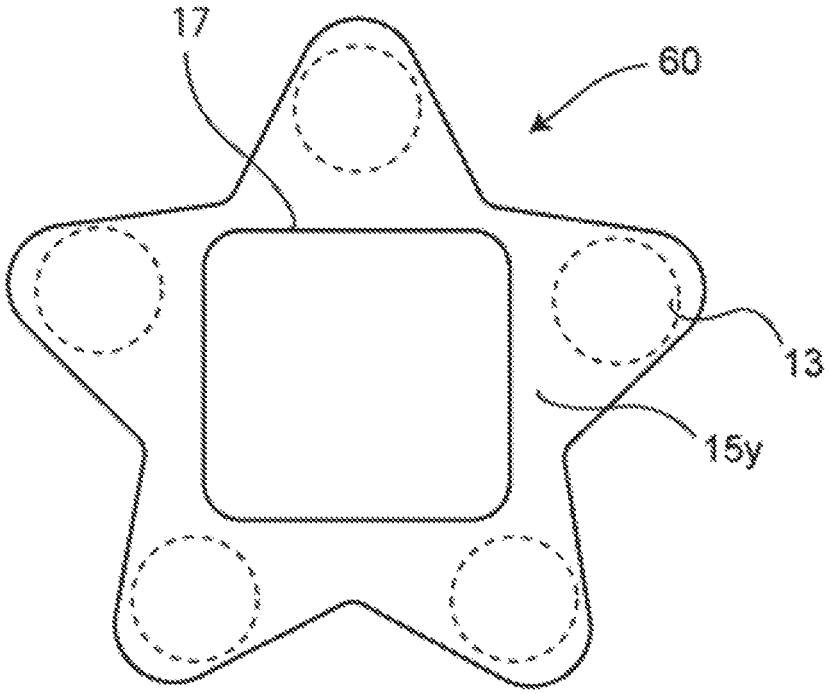

FIG. 6B is a plan view of a stretching slider 60 of a sixth embodiment (hereinafter, sometimes referred to as a stretching slider (No. 6)).

The stretching slider 60 of the sixth embodiment has a substantially stellate planar shape. Such a planar shape may be formed when the plate-shaped member is molded or machined. The ball rollers 13 are respectively provided in the regions of five stellate protrusion portions.

The stretching slider 60 of this sixth embodiment is capable of enhancing a product value in terms of design. In addition, since the ball rollers 13 are respectively provided in the regions of the stellate protrusion portions, the effect that the sitting of the stretching slider 60 with respect to a floor or the difficulty of tilting in the case of local and intensive external force application to the edge portion of the stretching slider 60 is also enhanced is also obtained.

EXAMPLE

Hereinafter, the invention will be described in more detail by means of examples.

However, the invention is not limited to the following description of the examples without any particular reason.

Example 1

1. Preparation of Stretching Slider (1) Preparation of Plate-Shaped Member

A wooden plate (thickness 10 mm) and four flanged ball rollers (BCHC40 manufactured by MISUMI Group Inc.) were prepared as the constituent materials of the plate-shaped member.

Next, the wooden plate was machined into a circular shape with a diameter of 20 cm and the edge portion was rounded and smoothened by means of an electric trimmer.

Further, four recesses corresponding to the size and shape of the ball roller were formed in the second surface.

(2) Disposition of Ball Roller

As illustrated in FIGS. 2A-2C, the stretching slider was formed by the four flanged ball rollers being respectively disposed in the four recesses of the second surface of the plate-shaped member and fixed with screws.

The distances between the center points of the ball rollers and the edge portion of the plate-shaped member were 25 mm without exception and the height of protrusion of the ball rollers from the second surface was 15 mm.

2. Evaluation of Stretching Slider (1) Lightweightness

The lightweightness of the obtained stretching slider was evaluated in accordance with the following criteria. Table 1 shows the obtained results.

⊙ (Very Good): 400 g or less in weight

○ (Good): 800 g or less in weight

Δ (Fair): 1 kg or less in weight x (Bad): Above 1 kg in weight (2) Compactness

The obtained stretching slider was accommodated in a medium-sized handbag (height: 24 cm, width: 30 cm, gusset width: 8 cm) and the compactness of the stretching slider was evaluated in accordance with the following criteria. Table 1 shows the obtained results.

⊙ (Very Good): Four or more stretching sliders can be suitably accommodated.

○ (Good): Two or more stretching sliders can be suitably accommodated.

Δ (Fair): One or more stretching sliders can be suitably accommodated.

x (Bad): No stretching slider can be suitably accommodated.

(3) Slipperiness

The slip angle of the obtained stretching slider was measured on a carpet (coefficient of static friction with urethane resin 0.73) and evaluated in accordance with the following criteria. Table 1 shows the obtained results.

⊙ (Very Good): The measured slip angle was 10° or less.

○ (Good): The measured slip angle was 20° or less.

Δ (Fair): The measured slip angle was 30° or less.

x (Bad): The measured slip angle was above 30°.

(4) Stretchability

Ten males and females in their teens to fifties did stretching exercise for 30 minutes by using the obtained stretching slider and with their palms, knees, and soles respectively placed on the slider.

After completion, the stretchability of the stretching slider that they used was evaluated in accordance with the following criteria. Table 1 shows the obtained results.

⊙ (Very Good): The stretching exercise could be suitably done regardless of the part placed on the slider in the posture.

○ (Good): In one posture, it was difficult to maintain the posture and the stretching exercise could not be suitably done.

Δ (Fair): In two postures, it was difficult to maintain the posture and the stretching exercise could not be suitably done.

x (Bad): In every posture, it was difficult to maintain the posture and the stretching exercise could not be suitably done.

Example 2

In Example 2, a stretching slider was produced and evaluated in the same manner as in Example 1 except that a cushioning member having the same planar shape as the plate-shaped member was stacked on the first surface of the plate-shaped member.

It should be noted that the cushioning member was a two-layer structure containing EVA resin and 20 mm in thickness.

Example 3

In Example 3, a stretching slider was produced and evaluated in the same manner as in Example 1 except that a cushioning member having the same planar shape as the plate-shaped member was stacked on the first surface of the plate-shaped member and a circular recess portion was provided in the cushioning member.

It should be noted that the cushioning member was a two-layer structure containing EVA resin and 20 mm in thickness and the recess portion was 5 mm in depth.

Example 4

In Example 4, a stretching slider was produced and evaluated in the same manner as in Example 2 except that a cushioning member having the same planar shape as the plate-shaped member was stacked on the first surface of the plate-shaped member and eight bolt-type ball rollers (BCHL8 manufactured by MISUMI Group Inc.) were used.

It should be noted that the distances between the center points of the ball rollers and the edge portion of the plate-shaped member were 15 mm without exception and the height of protrusion of the ball rollers from the second surface was 8 mm.

Comparative Example 1

Figure 7A:
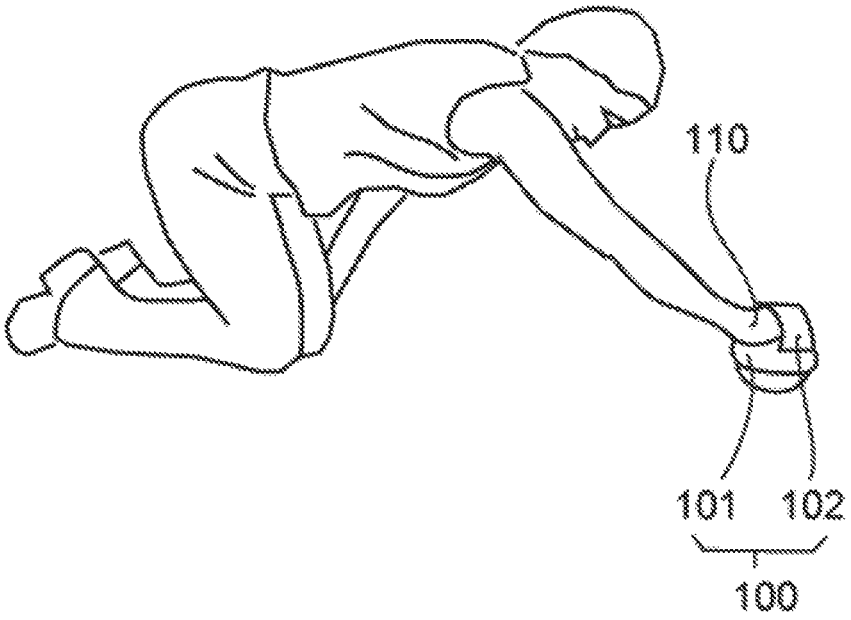
Related Art Fig. 7A
FIG. 7A is a diagram provided for describing a stretching slider of the related art together with a state of use and FIG. 7B is a view provided for describing a structural overview of the stretching slider of the related art.
Figure 7B:
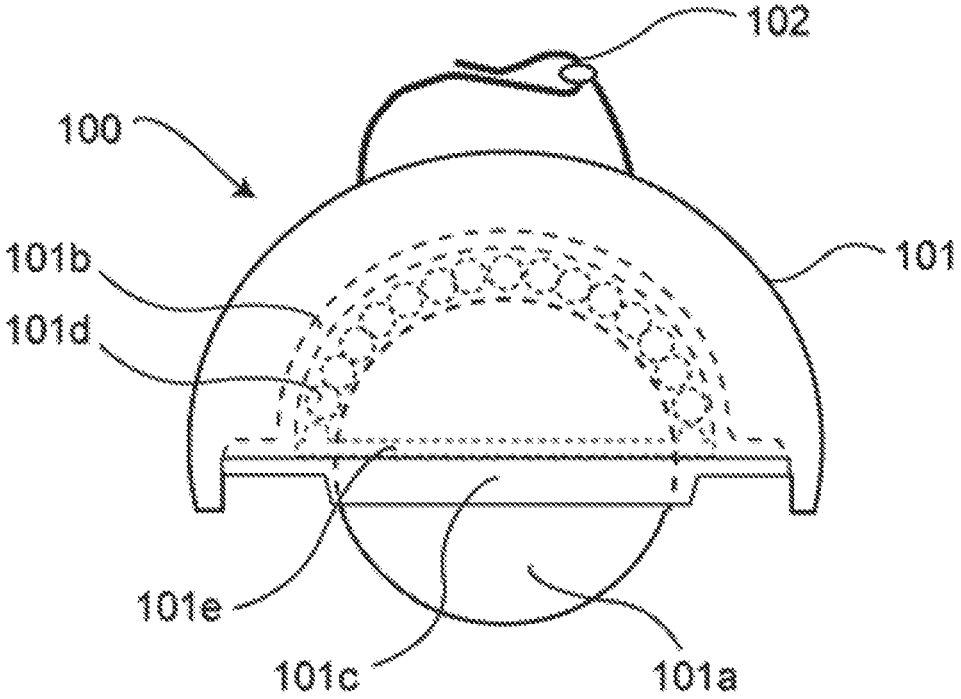

In Comparative Example 1, the stretching slider of the related art illustrated in FIGS. 7A and 7B and configured so as to include one large roller ball was used and the lightweightness and the like were evaluated in accordance with the same criteria as in Example 1. Table 1 shows the obtained results.

Comparative Example 2

Figure 8:
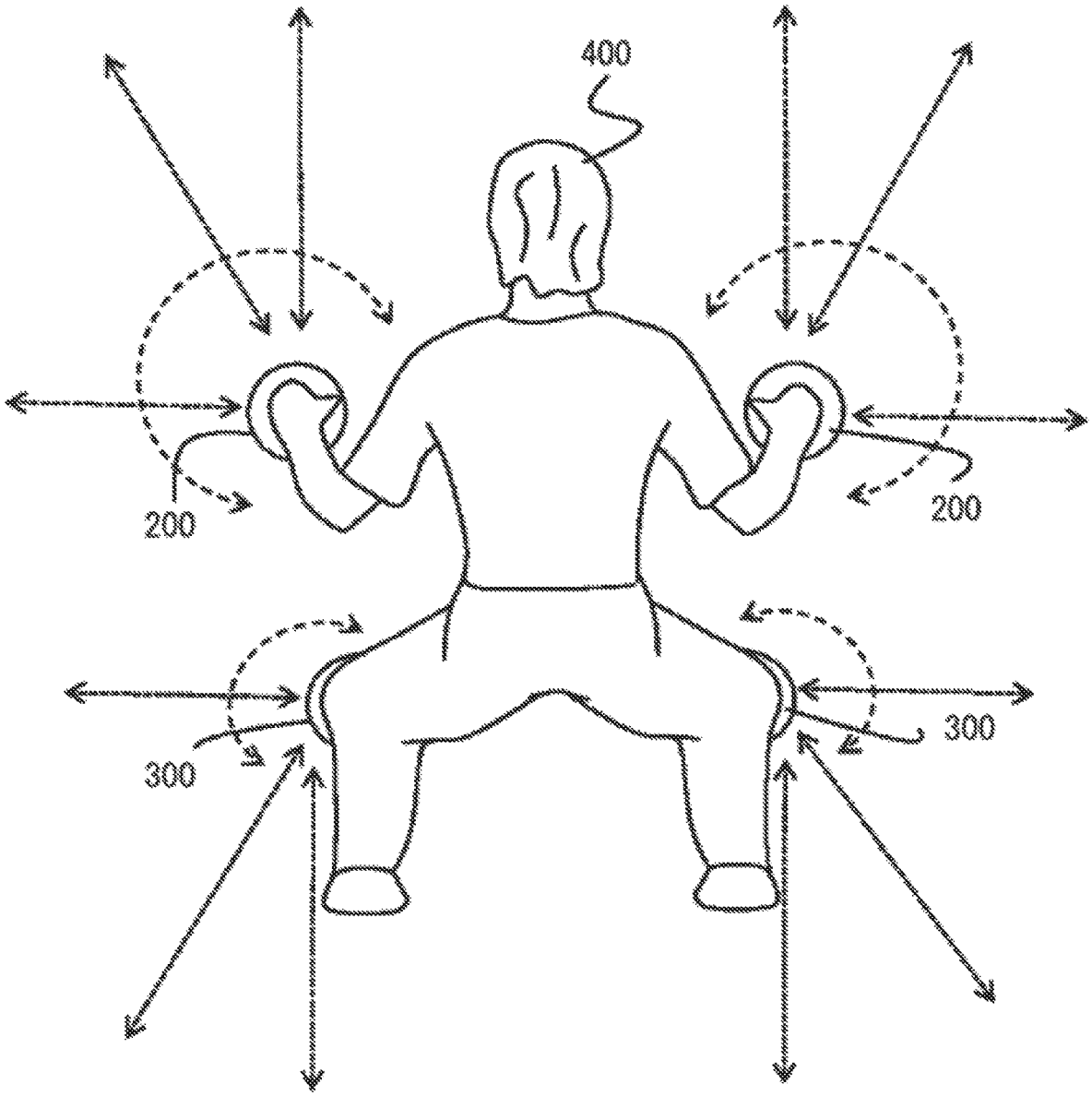
Related Art Fig. 8
FIG. 8 is a diagram provided for describing an example of use of a limb slider of the related art.

In Comparative Example 2, the limb support exercise system of the related art illustrated in FIG. 8 and including a first limb slider and a second limb slider was used and the lightweightness and the like were evaluated in accordance with the same criteria as in Example 1. Table 1 shows the obtained results.

TABLE 1

| | Plate-shaped member | Ball roller | Lightweightness | Compactness | Slipperiness | Stretchability |
|---|---|---|---|---|---|---|
| Example 1 | Present | Four | ⊙ | ⊙ | ⊙ | ○ |
| Example 2 | Present | Four | ⊙ | ○ | ⊙ | ⊙ |
| Example 3 | Present | Four | ⊙ | ○ | ⊙ | ⊙ |
| Example 4 | Present | Eight | ○ | ○ | ⊙ | ⊙ |
| Comparative Example 1 | Absent | One | X | X | ○ | ○ |
| Comparative Example 2 | — | Absent | ⊙ | ○ | X | X |

("—" in the table means a case where the corresponding point is absent or indistinguishable.)

INDUSTRIAL APPLICABILITY

As described above, according to the stretching slider of the invention, a stretching slider excellent in compactness and lightweightness and exhibiting high stability and slipperiness can be provided.

In other words, the stretching slider includes the plate-shaped member and the small ball roller industrially mass-produced as described in the embodiment, and thus the stretching slider is excellent in compactness and lightweightness and easy to transport.

In addition, since the stretching slider exhibits high stability, it is possible to easily obtain a stretching effect in the case of use by those without sufficient physical strength such as senior citizens and children as well as the case of use by those conducting daily training as a daily routine such as athletes. As a result, usability is anticipated for a wide range of age groups.

In addition, since the movement of the stretching slider is performed via the ball roller, the stretching slider has high slipperiness and can be easily used even on a floor surface having a high coefficient of friction.

Further, the stretching slider of the invention is economically advantageous since the stretching slider has a simple structure as described above.

According to the above, the stretching slider of the invention has extremely high industrial applicability as a type of instrument effective for health measures against the aging of the society to proceed in the future.

The documents described in the specification and the disclosure of a Japanese application on the basis of which the present application claims Paris Convention priority, which disclosure includes specification, drawings and claims, are incorporated herein by reference in its entirety.

REFERENCE SIGNS LIST

10 STRETCHING SLIDER (No. 1)
11 PLATE-SHAPED MEMBER
11*b* FIRST SURFACE
11*a* SECOND SURFACE
13, 13*x*, 13*s* BALL ROLLER
15, 15*a*, 15*b* CUSHIONING MEMBER
17 RECESS PORTION
19 UNEVENNESS
20 STRETCHING SLIDER (No. 2)
30 STRETCHING SLIDER (No. 3)
40 STRETCHING SLIDER (No. 4)
50 STRETCHING SLIDER (No. 5)
60 STRETCHING SLIDER (No. 6)

What is claimed is:

1. A stretching slider comprising:

a plate-shaped member having a first surface as a front surface and a second surface as a back surface; and a plurality of ball rollers provided on the second surface for moving the plate-shaped member in all directions along a horizontal surface, wherein the stretching slider comprises:

a cushioning member having a multilayer configuration stacked on the first surface of the plate-shaped member and the cushioning member is configured to have an uneven surface, and wherein a height difference of the uneven surface is a value within the range of 5 to 30 mm;

each layer of the multilayer configuration of the cushioning member contains at least one of urethane resin, EVA resin, styrene resin, polyester resin, and acrylic resin;

the plurality of ball rollers comprise five or more ball rollers;

a shortest distance between center points of the plurality of ball rollers and an edge portion of the plate-shaped member is a value within the range of 15 to 30 mm;

the plurality of ball rollers are provided at least along an edge of the second surface;

the plurality of ball rollers are radially provided when viewed from a center point of the plate-shaped member; and a height of protrusion of a ball roller of the plurality of ball rollers from the second surface is a value within the range of 10 to 20 mm.

2. The stretching slider according to claim 1, wherein the cushioning member has a two-layer structure of a first cushioning member and a second cushioning member, which are provided in order from the plate-shaped member side.

3. The stretching slider according to claim 2, wherein the first cushioning member is made of the urethane resin and the second cushioning member is made of the EVA resin.

4. The stretching slider according to claim 2, wherein a thickness of each of the first cushioning member and the second cushioning member is 10 mm.

5. The stretching slider according to claim 1, wherein a maximum diameter in a planar shape of the plate-shaped member is a value within the range of 15 to 35 cm.

6. The stretching slider according to claim 1, wherein a thickness of the cushioning member is a value within the range of 10 to 40 mm.

7. The stretching slider according to claim 1, wherein a planar shape of the plate-shaped member is a circular shape.

8. The stretching slider according to claim 1, wherein the plurality of ball rollers are disposed at positions corresponding to five vertices of a regular pentagon.

9. The stretching slider according to claim 1, wherein the plurality of ball rollers emit a predetermined sound as the plurality of ball rollers rotate.

10. The stretching slider according to claim 1, wherein the plurality of ball rollers comprise ten or less ball rollers.

* * * * *